US010494838B2

(12) United States Patent
Patel et al.

(10) Patent No.: US 10,494,838 B2
(45) Date of Patent: Dec. 3, 2019

(54) ELECTRONIC INTERIOR DOOR RELEASE SYSTEM

(71) Applicant: Ford Global Technologies, LLC, Dearborn, MI (US)

(72) Inventors: Rajesh K. Patel, Farmington Hills, MI (US); Kosta Papanikolaou, Huntington Woods, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 307 days.

(21) Appl. No.: 15/359,767

(22) Filed: Nov. 23, 2016

(65) Prior Publication Data

US 2017/0074006 A1 Mar. 16, 2017

Related U.S. Application Data

(63) Continuation of application No. 13/287,362, filed on Nov. 2, 2011, now Pat. No. 9,551,166.

(51) Int. Cl.

| | |
|---|---|
| ***E05B 85/12*** | (2014.01) |
| ***E05B 77/54*** | (2014.01) |
| ***E05B 79/20*** | (2014.01) |
| ***E05B 81/08*** | (2014.01) |
| ***E05B 47/06*** | (2006.01) |
| ***E05B 77/24*** | (2014.01) |
| ***E05B 81/90*** | (2014.01) |

(52) U.S. Cl.

CPC ..... *E05B 77/54* (2013.01); *E05B 47/0657* (2013.01); *E05B 77/245* (2013.01); *E05B 79/20* (2013.01); *E05B 81/08* (2013.01); *E05B 81/77* (2013.01); *E05B 81/90* (2013.01); *E05B 85/12* (2013.01); *Y10T 292/1082* (2015.04)

(58) Field of Classification Search

CPC ..... E05B 77/54; E05B 77/245; E05B 79/20; E05B 81/90; E05B 81/08; E05B 85/12; E05B 47/0657

See application file for complete search history.

(56) References Cited

U.S. PATENT DOCUMENTS

| | | | |
|---|---|---|---|
| 2,229,909 | A | 1/1941 | Wread |
| 3,479,767 | A | 11/1969 | Gardner et al. |
| 3,751,718 | A | 8/1973 | Hanchett |
| 3,854,310 | A | 12/1974 | Paull |

(Continued)

FOREIGN PATENT DOCUMENTS

| | | | |
|---|---|---|---|
| CN | 1232936 | C | 12/2005 |
| CN | 201198681 | Y | 2/2009 |

(Continued)

OTHER PUBLICATIONS

Zipcar.com, "Car Sharing from Zipcar: How Does car Sharing Work?" Feb. 9, 2016, 6 pages.

(Continued)

*Primary Examiner* — Catherine A Kelly
*Assistant Examiner* — Abe Massad
(74) *Attorney, Agent, or Firm* — Vichit Chea; Price Heneveld LLP

(57) ABSTRACT

A powered door latch may be actuated by a capacitive sensor or by movement of a mechanical release device. A controller may be utilized to prevent unlatching of the powered latch unless the vehicle is in Park and/or certain operating conditions are present.

14 Claims, 5 Drawing Sheets

(56) References Cited

U.S. PATENT DOCUMENTS 3,858,922 A 1/1975 Yamanaka
4,193,619 A 3/1980 Jerila
4,206,491 A 6/1980 Ligman et al.
4,425,597 A 1/1984 Schramm
4,457,148 A 7/1984 Johansson et al.
4,640,050 A 2/1987 Yamagishi et al.
4,672,348 A 6/1987 Duve
4,674,230 A 6/1987 Takeo et al.
4,674,781 A 6/1987 Reece et al.
4,702,117 A 10/1987 Tsutsumi et al.
4,848,031 A 6/1989 Yamagishi et al.
4,858,971 A 8/1989 Haag
4,889,373 A 12/1989 Ward et al.
4,929,007 A 5/1990 Bartczak et al.
5,018,057 A 5/1991 Biggs et al.
5,056,343 A 10/1991 Kleefeldt et al.
5,058,258 A 10/1991 Harvey
5,074,073 A 12/1991 Zwebner
5,239,779 A 8/1993 Deland et al.
5,263,762 A 11/1993 Long et al.
5,297,010 A 3/1994 Camarota et al.
5,332,273 A 7/1994 Komachi
5,334,969 A 8/1994 Abe et al.
5,494,322 A 2/1996 Menke
5,497,641 A 3/1996 Linde et al.
5,535,608 A 7/1996 Brin
5,547,208 A 8/1996 Chappell et al.
5,558,372 A * 9/1996 Kapes ..... E05B 83/36 292/336.3
5,581,230 A 12/1996 Barrett
5,583,405 A 12/1996 Sai et al.
5,618,068 A 4/1997 Mitsui et al.
5,632,120 A 5/1997 Shigematsu et al.
5,632,515 A 5/1997 Dowling
5,644,869 A 7/1997 Buchanan, Jr.
5,653,484 A 8/1997 Brackmann et al.
5,662,369 A 9/1997 Tsuge
5,684,470 A 11/1997 Deland et al.
5,744,874 A 4/1998 Yoshida et al.
5,755,059 A 5/1998 Schap
5,783,994 A 7/1998 Koopman, Jr. et al.
5,802,894 A 9/1998 Jahrsetz et al.
5,808,555 A 9/1998 Bartel
5,852,944 A 12/1998 Collard, Jr. et al.
5,859,417 A 1/1999 David
5,896,026 A 4/1999 Higgins
5,896,768 A 4/1999 Cranick et al.
5,901,991 A 5/1999 Hugel et al.
5,921,612 A 7/1999 Mizuki et al.
5,927,794 A 7/1999 Mobius
5,964,487 A 10/1999 Shamblin
5,979,754 A 11/1999 Martin et al.
5,992,194 A 11/1999 Baukholt et al.
6,000,257 A 12/1999 Thomas
6,027,148 A 2/2000 Shoemaker
6,038,895 A 3/2000 Menke et al.
6,042,159 A 3/2000 Spitzley et al.
6,043,735 A 3/2000 Barrett
6,050,117 A 4/2000 Weyerstall
6,056,076 A 5/2000 Bartel et al.
6,065,316 A 5/2000 Sato et al.
6,072,403 A 6/2000 Iwasaki et al.
6,075,294 A 6/2000 Van den Boom et al.
6,089,626 A 7/2000 Shoemaker
6,091,162 A 7/2000 Williams, Jr. et al.
6,099,048 A 8/2000 Salmon et al.
6,106,036 A * 8/2000 Okada ..... E05B 1/0038 292/336.3
6,125,583 A 10/2000 Murray et al.
6,130,614 A 10/2000 Miller
6,145,918 A 11/2000 Wilbanks, II
6,157,090 A 12/2000 Vogel
6,181,024 B1 1/2001 Geil
6,198,995 B1 3/2001 Settles et al.
6,241,294 B1 6/2001 Young et al.
6,247,343 B1 6/2001 Weiss et al.
6,256,932 B1 7/2001 Jyawook et al.
6,271,745 B1 8/2001 Anazi et al.
6,341,448 B1 1/2002 Murray
6,361,091 B1 3/2002 Weschler
6,405,485 B1 6/2002 Itami et al.
6,441,512 B1 8/2002 Jakel et al.
6,460,905 B2 10/2002 Suss
6,470,719 B1 10/2002 Franz et al.
6,480,098 B2 11/2002 Flick
6,515,377 B1 2/2003 Uberlein et al.
6,523,376 B2 2/2003 Baukholt et al.
6,550,826 B2 4/2003 Fukushima et al.
6,554,328 B2 4/2003 Cetnar et al.
6,556,900 B1 4/2003 Brynielsson
6,602,077 B2 8/2003 Kasper et al.
6,606,492 B1 8/2003 Losey
6,629,711 B1 10/2003 Gleason et al.
6,639,161 B2 10/2003 Meagher et al.
6,657,537 B1 12/2003 Hauler
6,659,515 B2 12/2003 Raymond et al.
6,701,671 B1 3/2004 Fukumoto et al.
6,712,409 B2 3/2004 Monig
6,715,806 B2 4/2004 Arlt et al.
6,734,578 B2 5/2004 Konno et al.
6,740,834 B2 5/2004 Sueyoshi et al.
6,768,413 B1 7/2004 Kemmann et al.
6,779,372 B2 8/2004 Arlt et al.
6,783,167 B2 8/2004 Bingle et al.
6,786,070 B1 9/2004 Dimig et al.
6,794,837 B1 9/2004 Whinnery et al.
6,825,752 B2 11/2004 Nahata et al.
6,829,357 B1 12/2004 Alrabady et al.
6,843,085 B2 1/2005 Dimig
6,854,870 B2 2/2005 Huizenga
6,879,058 B2 4/2005 Lorenz et al.
6,883,836 B2 4/2005 Breay et al.
6,883,839 B2 4/2005 Belmond et al.
6,896,302 B2 * 5/2005 Belchine, III ..... E05B 1/0038 292/110
6,914,346 B2 7/2005 Girard
6,923,479 B2 8/2005 Aiyama et al.
6,933,655 B2 8/2005 Morrison et al.
6,948,978 B2 9/2005 Schofield
7,005,959 B2 2/2006 Amagasa
7,038,414 B2 5/2006 Daniels et al.
7,055,997 B2 6/2006 Baek
7,062,945 B2 6/2006 Saitoh et al.
7,070,018 B2 7/2006 Kachouh
7,070,213 B2 7/2006 Willats et al.
7,090,285 B2 8/2006 Markevich et al.
7,091,823 B2 8/2006 Ieda et al.
7,091,836 B2 8/2006 Kachouh et al.
7,097,226 B2 8/2006 Bingle et al.
7,106,171 B1 9/2006 Burgess
7,108,301 B2 9/2006 Louvel
7,126,453 B2 10/2006 Sandau et al.
7,145,436 B2 12/2006 Ichikawa et al.
7,161,152 B2 1/2007 Dipoala
7,170,253 B2 1/2007 Spurr et al.
7,173,346 B2 2/2007 Aiyama et al.
7,176,810 B2 2/2007 Inoue
7,180,400 B2 2/2007 Amagasa
7,192,076 B2 3/2007 Ottino
7,204,530 B2 4/2007 Lee
7,205,777 B2 4/2007 Schultz et al.
7,221,255 B2 5/2007 Johnson et al.
7,222,459 B2 5/2007 Taniyama
7,248,955 B2 7/2007 Hein et al.
7,263,416 B2 8/2007 Sakurai et al.
7,270,029 B1 9/2007 Papanikolaou et al.
7,325,843 B2 2/2008 Coleman et al.
7,342,373 B2 3/2008 Newman et al.
7,360,803 B2 4/2008 Parent et al.
7,363,788 B2 4/2008 Dimig et al.
7,375,299 B1 5/2008 Pudney
7,399,010 B2 7/2008 Hunt et al.
7,446,656 B2 11/2008 Steegmann
7,576,631 B1 8/2009 Bingle et al.

(56) References Cited

U.S. PATENT DOCUMENTS 7,642,669 B2 1/2010 Spurr
7,686,378 B2 3/2010 Gisler et al.
7,688,179 B2 3/2010 Kurpinski et al.
7,705,722 B2 4/2010 Shoemaker et al.
7,747,286 B2 6/2010 Conforti
7,780,207 B2 8/2010 Gotou et al.
7,791,218 B2 9/2010 Mekky et al.
7,926,385 B2 4/2011 Papanikolaou et al.
7,931,314 B2 4/2011 Nitawaki et al.
7,937,893 B2 5/2011 Pribisic
8,028,375 B2 10/2011 Nakaura et al.
8,093,987 B2 1/2012 Kurpinski et al.
8,126,450 B2 2/2012 Howarter et al.
8,141,296 B2 3/2012 Bem
8,141,916 B2 3/2012 Tomaszewski et al.
8,169,317 B2 5/2012 Lemerand et al.
8,193,462 B2 6/2012 Zanini et al.
8,224,313 B2 7/2012 Howarter et al.
8,376,416 B2 2/2013 Arabia, Jr. et al.
8,398,128 B2 3/2013 Arabia et al.
8,405,515 B2 3/2013 Ishihara et al.
8,419,114 B2 4/2013 Fannon
8,451,087 B2 5/2013 Krishnan et al.
8,454,062 B2 6/2013 Rohlfing et al.
8,474,889 B2 7/2013 Reifenberg et al.
8,532,873 B1 9/2013 Bambenek
8,534,101 B2 9/2013 Mette et al.
8,544,901 B2 10/2013 Krishnan et al.
8,573,657 B2 11/2013 Papanikolaou et al.
8,616,595 B2 12/2013 Wellborn, Sr. et al.
8,648,689 B2 2/2014 Hathaway et al.
8,746,755 B2 6/2014 Papanikolaou et al.
8,826,596 B2 9/2014 Tensing
8,833,811 B2 9/2014 Ishikawa
8,903,605 B2 12/2014 Bambenek
8,915,524 B2 12/2014 Charnesky
8,963,701 B2 2/2015 Rodriguez
8,965,287 B2 2/2015 Lam
9,076,274 B2 7/2015 Kamiya
9,159,219 B2 10/2015 Magner et al.
9,184,777 B2 11/2015 Esselink et al.
9,187,012 B2 11/2015 Sachs et al.
9,189,900 B1 11/2015 Penilla et al.
9,260,882 B2 2/2016 Krishnan et al.
9,284,757 B2 3/2016 Kempel
9,405,120 B2 8/2016 Graf
9,409,579 B2 8/2016 Eichin et al.
9,416,565 B2 8/2016 Papanikolaou et al.
9,518,408 B1 12/2016 Krishnan
9,546,502 B2 1/2017 Lange
9,551,166 B2 1/2017 Patel et al.
9,725,069 B2 8/2017 Krishnan
9,777,528 B2 10/2017 Elie et al.
9,797,178 B2 10/2017 Elie et al.
9,834,964 B2 12/2017 Van Wiemeersch et al.
9,845,071 B1 12/2017 Krishnan
9,903,142 B2 2/2018 Van Wiemeersch et al.
9,909,344 B2 3/2018 Krishnan et al.
9,957,737 B2 5/2018 Patel et al.
2001/0005078 A1 6/2001 Fukushima et al.
2001/0030871 A1 10/2001 Anderson
2002/0000726 A1 1/2002 Zintler
2002/0111844 A1 8/2002 Vanstory et al.
2002/0121967 A1 9/2002 Bowen et al.
2002/0186144 A1 12/2002 Meunier
2003/0009855 A1 1/2003 Budzynski
2003/0025337 A1 2/2003 Suzuki et al.
2003/0038544 A1 2/2003 Spurr
2003/0101781 A1 6/2003 Budzynski et al.
2003/0107473 A1 6/2003 Pang et al.
2003/0111863 A1 6/2003 Weyerstall et al.
2003/0139155 A1 7/2003 Sakai
2003/0172695 A1 9/2003 Buschmann
2003/0182863 A1 10/2003 Mejean et al.
2003/0184098 A1 10/2003 Aiyama
2004/0061462 A1 4/2004 Bent et al.
2004/0093155 A1 5/2004 Simonds et al.
2004/0124708 A1 7/2004 Giehler et al.
2004/0195845 A1 10/2004 Chevalier
2004/0217601 A1 11/2004 Gamault et al.
2005/0057047 A1 3/2005 Kachouh et al.
2005/0068712 A1 3/2005 Schulz et al.
2005/0216133 A1 9/2005 MacDougall et al.
2005/0218913 A1 10/2005 Inaba
2006/0056663 A1 3/2006 Call
2006/0100002 A1 5/2006 Luebke et al.
2006/0186987 A1 8/2006 Wilkins
2007/0001467 A1 1/2007 Muller et al.
2007/0090654 A1 4/2007 Eaton
2007/0115191 A1 5/2007 Hashiguchi et al.
2007/0120645 A1 5/2007 Nakashima
2007/0126243 A1 6/2007 Papanikolaou et al.
2007/0132553 A1 6/2007 Nakashima
2007/0170727 A1 7/2007 Kohlstrand et al.
2008/0021619 A1 1/2008 Steegmann et al.
2008/0060393 A1 3/2008 Johansson et al.
2008/0068129 A1 3/2008 Leda et al.
2008/0129446 A1 6/2008 Vader
2008/0143139 A1 6/2008 Bauer et al.
2008/0202912 A1 8/2008 Boddie et al.
2008/0203737 A1 8/2008 Tomaszewski et al.
2008/0211623 A1 9/2008 Scheurich
2008/0217956 A1 9/2008 Gschweng et al.
2008/0224482 A1 9/2008 Cumbo et al.
2008/0230006 A1 9/2008 Kirchoff et al.
2008/0250718 A1 10/2008 Papanikolaou et al.
2008/0296927 A1 12/2008 Gisler et al.
2008/0303291 A1 12/2008 Spurr
2008/0307711 A1 12/2008 Kern et al.
2009/0033104 A1 2/2009 Konchan et al.
2009/0033477 A1 2/2009 Illium et al.
2009/0145181 A1 6/2009 Pecoul et al.
2009/0160211 A1 6/2009 Krishnan et al.
2009/0177336 A1 7/2009 McClellan et al.
2009/0240400 A1 9/2009 Lachapelle et al.
2009/0257241 A1 10/2009 Meinke et al.
2010/0007463 A1 1/2010 Dingman et al.
2010/0005233 A1 3/2010 Arabia et al.
2010/0052337 A1 3/2010 Arabia, Jr. et al.
2010/0060505 A1 3/2010 Witkowski
2010/0097186 A1 4/2010 Wielebski
2010/0175945 A1 7/2010 Helms
2010/0235057 A1 9/2010 Papanikolaou et al.
2010/0235058 A1 9/2010 Papanikolaou et al.
2010/0235059 A1 9/2010 Krishnan et al.
2010/0237635 A1 9/2010 Ieda et al.
2010/0253535 A1 10/2010 Thomas
2010/0265034 A1 10/2010 Cap et al.
2010/0315267 A1 12/2010 Chung et al.
2011/0041409 A1 2/2011 Newman et al.
2011/0060480 A1 3/2011 Mottla et al.
2011/0148575 A1 6/2011 Sobecki et al.
2011/0154740 A1 6/2011 Matsumoto et al.
2011/0180350 A1 7/2011 Thacker
2011/0203181 A1 8/2011 Magner et al.
2011/0203336 A1 8/2011 Mette et al.
2011/0227351 A1 9/2011 Grosedemouge
2011/0248862 A1 10/2011 Budampati
2011/0252845 A1 10/2011 Webb et al.
2011/0313937 A1 12/2011 Moore, Jr. et al.
2012/0119524 A1 5/2012 Bingle et al.
2012/0154292 A1 6/2012 Zhao et al.
2012/0180394 A1 7/2012 Shinohara
2012/0205925 A1 8/2012 Muller et al.
2012/0228886 A1 9/2012 Muller et al.
2012/0252402 A1 10/2012 Jung
2013/0069761 A1 3/2013 Tieman
2013/0079984 A1 3/2013 Aerts et al.
2013/0104459 A1 5/2013 Patel
2013/0127180 A1 5/2013 Heberer et al.
2013/0138303 A1 5/2013 McKee et al.
2013/0207794 A1 8/2013 Patel
2013/0282226 A1 10/2013 Pollmann
2013/0295913 A1 11/2013 Matthews, III et al.

(56) References Cited

U.S. PATENT DOCUMENTS

| | | | |
|---|---|---|---|
| 2013/0311046 | A1 | 11/2013 | Heberer et al. |
| 2013/0321065 | A1 | 12/2013 | Salter et al. |
| 2013/0325521 | A1 | 12/2013 | Jameel |
| 2014/0000165 | A1 | 1/2014 | Patel et al. |
| 2014/0007404 | A1 | 1/2014 | Krishnan et al. |
| 2014/0015637 | A1 | 1/2014 | Dassanakake et al. |
| 2014/0088825 | A1 | 3/2014 | Lange et al. |
| 2014/0129113 | A1 | 5/2014 | Van Wiemersch et al. |
| 2014/0150581 | A1 | 6/2014 | Scheuring et al. |
| 2014/0156111 | A1 | 6/2014 | Ehrman |
| 2014/0188999 | A1 | 7/2014 | Leonard et al. |
| 2014/0200774 | A1 | 7/2014 | Lange et al. |
| 2014/0227980 | A1 | 8/2014 | Esselink et al. |
| 2014/0242971 | A1 | 8/2014 | Aladenize et al. |
| 2014/0245666 | A1 | 9/2014 | Ishida et al. |
| 2014/0256304 | A1 | 9/2014 | Frye et al. |
| 2014/0278599 | A1 | 9/2014 | Reh |
| 2014/0293753 | A1 | 10/2014 | Pearson |
| 2014/0338409 | A1 | 11/2014 | Kraus et al. |
| 2014/0347163 | A1 | 11/2014 | Banter et al. |
| 2015/0001926 | A1 | 1/2015 | Kageyama et al. |
| 2015/0048927 | A1 | 2/2015 | Simmons |
| 2015/0059250 | A1 | 3/2015 | Miu et al. |
| 2015/0084739 | A1 | 3/2015 | Lemoult et al. |
| 2015/0149042 | A1 | 5/2015 | Cooper et al. |
| 2015/0161832 | A1 | 6/2015 | Esselink et al. |
| 2015/0197205 | A1 | 7/2015 | Xiong |
| 2015/0240548 | A1 | 8/2015 | Bendel et al. |
| 2015/0294518 | A1 | 10/2015 | Peplin |
| 2015/0330112 | A1 | 11/2015 | Van Wiemeersch et al. |
| 2015/0330113 | A1 | 11/2015 | Van Wiemeersch et al. |
| 2015/0330114 | A1 | 11/2015 | Linden et al. |
| 2015/0330117 | A1 | 11/2015 | Van Wiemeersch et al. |
| 2015/0360545 | A1 | 12/2015 | Nanla |
| 2015/0371031 | A1 | 12/2015 | Ueno et al. |
| 2016/0060909 | A1 | 3/2016 | Krishnan et al. |
| 2016/0130843 | A1 | 5/2016 | Bingle |
| 2016/0138306 | A1 | 5/2016 | Krishnan et al. |
| 2016/0153216 | A1 | 6/2016 | Funahashi et al. |
| 2016/0326779 | A1 | 11/2016 | Papanikolaou et al. |
| 2017/0014039 | A1 | 1/2017 | Pahlevan et al. |
| 2017/0074006 | A1 | 3/2017 | Patel et al. |
| 2017/0247016 | A1 | 8/2017 | Krishnan |
| 2017/0270490 | A1 | 9/2017 | Penilla et al. |
| 2017/0306662 | A1 | 10/2017 | Och et al. |
| 2017/0349146 | A1 | 12/2017 | Krishnan |
| 2018/0038147 | A1 | 2/2018 | Linden et al. |
| 2018/0051493 | A1 | 2/2018 | Krishnan et al. |
| 2018/0051498 | A1 | 2/2018 | Van Wiemeersch et al. |
| 2018/0058128 | A1 | 3/2018 | Khan et al. |
| 2018/0065598 | A1 | 3/2018 | Krishnan |
| 2018/0080270 | A1 | 3/2018 | Khan et al. |
| 2018/0128022 | A1 | 5/2018 | Van Wiemeersh et al. |

FOREIGN PATENT DOCUMENTS

| | | | |
|---|---|---|---|
| CN | 101527061 | A | 9/2009 |
| CN | 201567872 | U | 9/2010 |
| CN | 101932466 | A | 12/2010 |
| CN | 201915717 | U | 8/2011 |
| CN | 202200933 | U | 4/2012 |
| CN | 202686247 | U | 1/2013 |
| CN | 103206117 | A | 7/2013 |
| CN | 103264667 | A | 8/2013 |
| CN | 203511548 | U | 4/2014 |
| CN | 204326814 | U | 5/2015 |
| DE | 4403655 | A1 | 8/1995 |
| DE | 19620059 | A1 | 11/1997 |
| DE | 19642698 | A1 | 4/1998 |
| DE | 19642698 | A2 | 11/2000 |
| DE | 10212794 | A1 | 6/2003 |
| DE | 20121915 | U1 | 11/2003 |
| DE | 10309821 | A1 | 9/2004 |
| DE | 102005041551 | A1 | 3/2007 |
| DE | 102006029774 | A1 | 1/2008 |
| DE | 102006041928 | A1 | 3/2008 |
| DE | 102010052582 | A1 | 5/2012 |
| DE | 102011051165 | A1 | 12/2012 |
| DE | 102015101164 | A1 | 7/2015 |
| DE | 102014107809 | A1 | 12/2015 |
| EP | 0372791 | A2 | 6/1990 |
| EP | 0694664 | A1 | 1/1996 |
| EP | 1162332 | A1 | 12/2001 |
| EP | 1284334 | A1 | 2/2003 |
| EP | 1288403 | A2 | 3/2003 |
| EP | 1284334 | A1 | 9/2003 |
| EP | 1460204 | A2 | 9/2004 |
| EP | 1465119 | A1 | 10/2004 |
| EP | 1338731 | A2 | 2/2005 |
| EP | 1944436 | A2 | 7/2008 |
| EP | 2053744 | A2 | 4/2009 |
| EP | 2314803 | A2 | 4/2011 |
| FR | 2698838 | A1 | 6/1994 |
| FR | 2783547 | A1 | 3/2000 |
| FR | 2841285 | A1 | 12/2003 |
| FR | 2948402 | A1 | 7/2009 |
| FR | 2955604 | A1 | 7/2011 |
| GB | 2402840 | A | 12/2004 |
| GB | 2496754 | A | 5/2013 |
| JP | 62255256 | A | 11/1987 |
| JP | 05059855 | A | 3/1993 |
| JP | 406167156 | A | 6/1994 |
| JP | 406185250 | A | 7/1994 |
| JP | 2000064685 | A | 2/2000 |
| JP | 2000314258 | A | 11/2000 |
| JP | 2007138500 | A | 6/2007 |
| KR | 20030025738 | A | 3/2003 |
| KR | 20120108580 | A | 10/2012 |
| WO | 0123695 | A1 | 4/2001 |
| WO | 03095776 | A1 | 11/2003 |
| WO | 2013111615 | A1 | 8/2013 |
| WO | 2013146918 | A1 | 10/2013 |
| WO | 2014146186 | A1 | 9/2014 |

OTHER PUBLICATIONS

Department of Transportation, "Federal Motor Vehicle Safety Standards; Door Locks and Door Retention Components and Side Impact Protection,"http://www.nhtsa.gov/cars/rules/rulings/DoorLocks/DoorLocks_NPRM.html#VI_C, 23 pages, Aug. 28, 2010.

"Push Button to open your car door" Online video clip. YouTube, Mar. 10, 2010. 1 page.

Car of the Week: 1947 Lincoln convertible by: bearnest May 29, 2012 http://www.oldcarsweekly.com/car-of-the-week/car-of-the-week-1947-lincoln-convertible. 7 pages.

U.S. Appl. No. 14/276,415, Office Action dated Mar. 28, 2018, 19 pages.

U.S. Appl. No. 12/402,744, Office Action dated Oct. 23, 2013, 7 pages.

U.S. Appl. No. 12/402,744, Advisory Action dated Jan. 31, 2014, 2 pages.

U.S. Appl. No. 14/280,035, filed May 16, 2014, entitled "Powered Latch System for Vehicle Doors and Control System Therefor."

U.S. Appl. No. 14/281,998, filed May 20, 2014, entitled "Vehicle Door Handle and Powered Latch System."

U.S. Appl. No. 14/282,224, filed May 20, 2014, entitled "Powered Vehicle Door Latch and Exterior Handle With Sensor."

George Kennedy, "Keyfree app replaces conventional keys with your smart phone," website, Jan. 5, 2015, 2 pages.

Hyundai Motor India Limited, "Hyundai Care," website, Dec. 8, 2015, 3 pages.

Keyfree Technologies Inc., "Keyfree," website, Jan. 10, 2014, 2 pages.

PRWEB, "Keyfree Technologies Inc. Launches the First Digital Car Key," Jan. 9, 2014, 3 pages.

General Motors Corporation, 2006 Chevrolet Corvette Owner Manual, © 2005 General Motors Corporation, 4 pages.

General Motors LLC, 2013 Chevrolet Corvette Owner Manual, 2012, 17 pages.

(56) References Cited

OTHER PUBLICATIONS

General Motors, "Getting to Know Your 2014 Corvette," Quick Reference Guide, 2013, 16 pages.
InterRegs Ltd., Federal Motor Vehicle Safety Standard, "Door Locks and Door Retention Components," 2012, F.R. vol. 36 No. 232—Feb. 12, 1971, 23 pages.
Ross Downing, "Flow to Enter & Exit a Corvette With a Dead Battery," YouTube video http://www.youtube.com/watch?v=DLDqmGQU6L0, Jun. 6, 2011, 1 page.
Jeff Glucker, "Friends videotape man 'trapped' inside C6 Corette with dead battery," YouTube via Corvett Online video hittp://www.autoblog.com/2011/05/14/friends-videotape-man-trapped-inside-c6-corvette-with-dead-bat/, May 14, 2011, 1 page.
Don Roy, "ZR1 Owner Calls 911 After Locking Self in Car," website http://www.corvetteonline.com/news/zr1-owner-calls-911-after-locking-self-in-car/, Apr. 13, 2011, 2 pages.
Zach Bowman, "Corvette with dead battery traps would-be thief," website http://www.autoblog.com/2011/10/25/corvette-with-dead-battery-traps-would-be-thief/, Oct. 25, 2011, 2 pages.
Kisteler Instruments, "Force Sensors Ensure Car Door Latch is Within Specification," Article, Jan. 1, 2005, 3 pages.
Bryan Laviolette, "GM's New App Turns Smartphones into Virtual Keys," Article, Jul. 22, 2010, 2 pages.
Hyundai Bluelink, "Send Directions to your car," Link to App, 2015, 3 pages.
Office Action dated Mar. 10, 2017, U.S. Appl. No. 15/174,206, filed Jun. 6, 2016, 17 pages.
U.S. Appl. No. 14/276,415, filed May 13, 2014, 18 pages.
U.S. Appl. No. 14/282,224, filed May 20, 2014, 15 pages.
U.S. Appl. No. 14/468,634, filed Aug. 26, 2014, 15 pages.
U.S. Appl. No. 13/608,303, filed Sep. 10, 2012, 15 pages.
U.S. Appl. No. 14/281,998, filed May 20, 2014, 20 pages.

* cited by examiner

ELECTRONIC INTERIOR DOOR RELEASE SYSTEM

CROSS REFERENCE TO RELATED APPLICATION

This application is a continuation of U.S. patent application Ser. No. 13/287,362, filed Nov. 2, 2011, and entitled "ELECTRONIC INTERIOR DOOR RELEASE SYSTEM," now U.S. Pat. No. 9,551,166, issued on Jan. 24, 2017, the entire disclosure of which is incorporated herein by reference.

FIELD OF THE INVENTION

The present invention generally relates to a powered latch for vehicles.

BACKGROUND OF THE INVENTION

Various powered latches with interior door releases for motor vehicles and the like have been developed. However, the powered latch may not operate properly if vehicle power is lost, and mechanical back up release arrangements have been developed to provide for unlatching of the vehicle door in the event the vehicle's main power supply is lost. However, known systems suffer from various drawbacks.

SUMMARY OF THE INVENTION

One aspect of the present invention is a vehicle door assembly including a powered latch release device. The door assembly includes a vehicle door having inner and outer opposite sides and a first side edge portion configured to be movably mounted to a vehicle. A second side edge of the door extends along an opposite edge of the vehicle door. The door assembly further includes a latch having a movable latch member and a powered actuator. The latch is mounted to the door adjacent the second side edge portion. A release member is movably mounted to the inner side of the vehicle door, and a mechanical member operably interconnects the release member to the movable latch member. Movement of the release member causes the movable latch member to move from a latched position to an unlatched position. The door further includes a capacitive or proximity sensor positioned adjacent the release member. The capacitive sensor is configured to detect an object moved to within a predefined vicinity or activation distance of the sensor. The powered actuator is operably connected to the movable latch member and shifts the latch member from a retaining position to a released position if the proximity sensor determines that an object is within the predefined vicinity. The activation distance may be optimized or tuned to provide either non-contact based activation or contact based activation.

The vehicle door assembly may be connected to a main vehicle electrical supply, and the powered actuator and proximity sensor may be operably connected to a programmable controller. The controller may be configured to release the latch only if an object is detected within the predefined vicinity twice within a predefined time interval. The programmable controller may also be configured to utilize vehicle operating parameters to control actuation of the powered actuator and unlatching of the powered latch device. For example, the controller may be operably connected to a sensor that determines when the vehicle transmission is in the Park position or state, and the controller may be configured to release the powered latch only if the vehicle transmission is in Park.

DETAILED DESCRIPTION OF THE PREFERRED EMBODIMENTS

Figure 1:
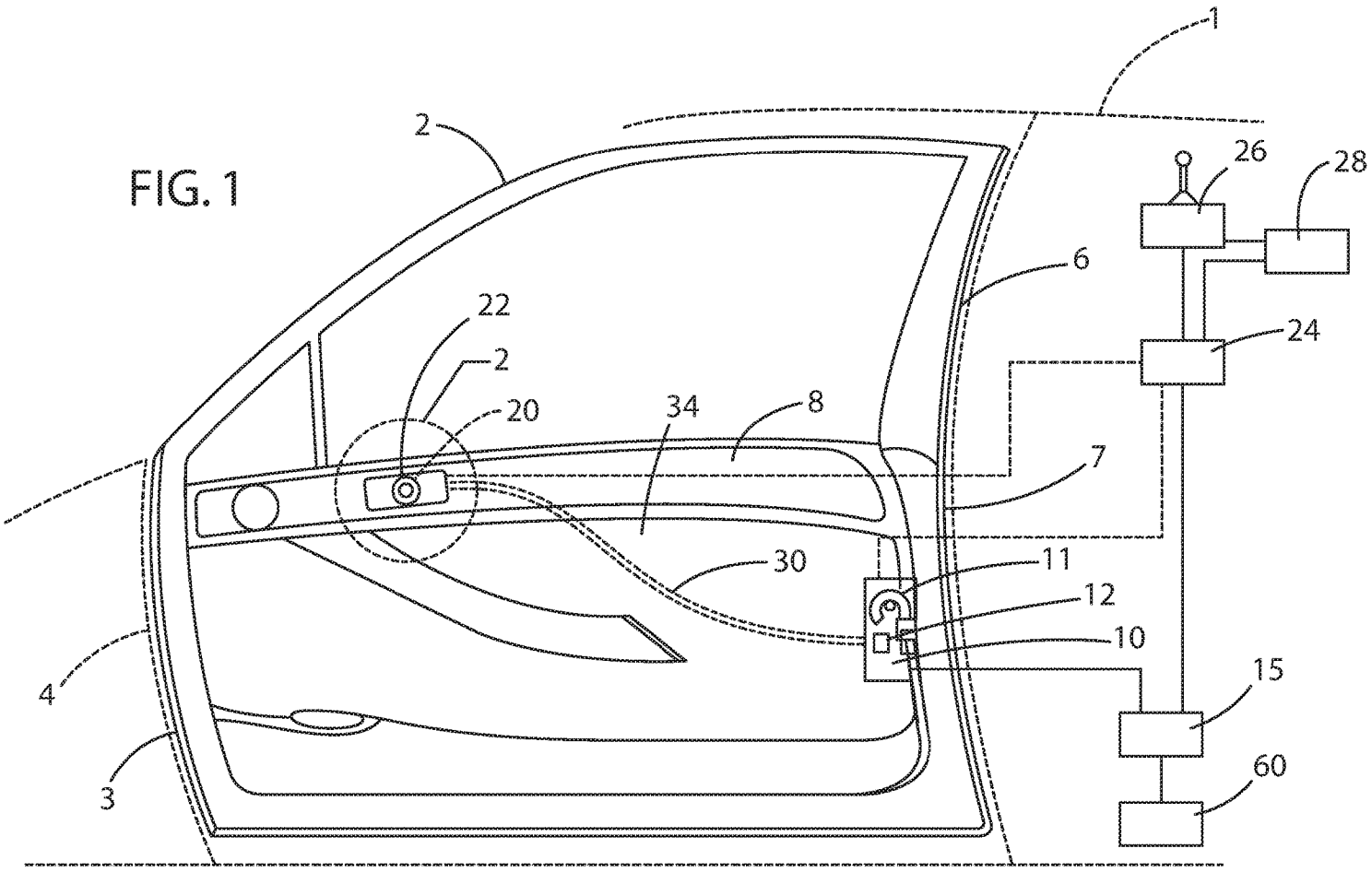
FIG. 1 is a side elevational view of a vehicle door including a powered latch and interior door released system according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a vehicle 1 includes a door assembly 2 that is movably mounted to a vehicle structure 4 along first edge 3 of door 2. In the illustrated example, the door 2 is pivotally mounted to the vehicle structure 4. The door assembly 2 includes a second side edge portion 6 extending along an opposite edge 7 of the door 2. The door assembly 2 also includes a powered latch device 10 that selectively latches the door to retain it in a closed position. The powered latch device 10 may comprise a powered latch as disclosed in U.S. Pat. No. 8,746,755 entitled "Universal Global Latch System", (U.S. Patent Publication No. 2010/0235057), and/or U.S. Pat. No. 8,544,901 entitled "Universal Global Latch System" (U.S. Patent Publication No. 2010/0235059), and/or the side door latch of U.S. Pat. No. 8,573,657 entitled "Latch Mechanism" (U.S. Patent Publication No. 2010/0235058), the entire contents of each of these applications being incorporated herein by reference.

As described in more detail in these patent applications, powered latch device 10 includes a movable latch member 11 and a powered actuator 12. The powered latch device 10 is mounted to the door 2 adjacent the second side edge portion 6. A release member 20 is movably mounted to the inner side 8 of the vehicle door 2. The release member 20 may include a capacitive sensor 22 mounted therein. The capacitive sensor 22 detects the presence of an object such as a users' hand that is within a predefined distance of the capacitive sensor 22. The powered latch device 10 and capacitive sensor 22 may be operably connected to a main vehicle power supply 15. The powered latch device 10 and sensor 22 may also be operably connected to a controller 24 that may be programmed to control operation of the powered latch 10. Controller 24 may also be operably connected to a gear shift selector mechanism 26 and/or a vehicle transmission 28. The gear shift selector 26 may comprise a conventional shift selection lever for automatic transmissions, and may define Park, Reverse, Neutral, Drive, and/or other control positions that provide operator input with respect to control of transmission 28. Gear shift selector 26 may also comprise a manual shift lever or other operator input device.

A mechanical member such as a mechanical cable 30 extends through an interior space 34 of door 2, and mechanically interconnects release member 20 to the powered latch device 10. Cable 30 may include an outer sheath 31 and an inner flexible cable member 32 (FIG. 3).

Figure 2:
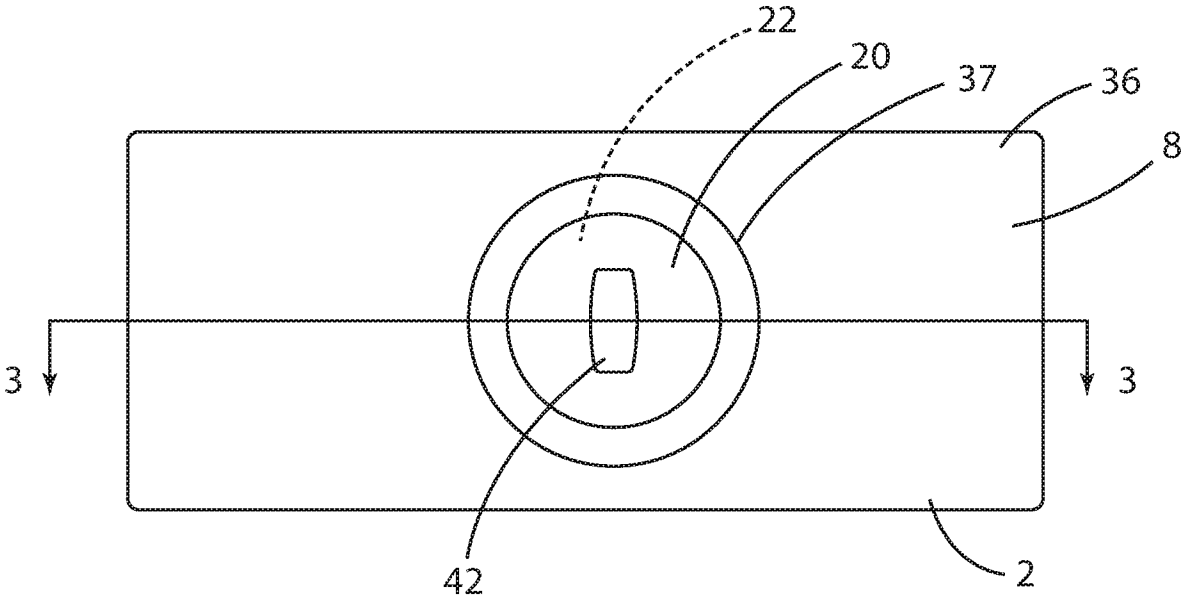
FIG. 2 is an enlarged view of a portion of the door of FIG. 1.
Figure 3:
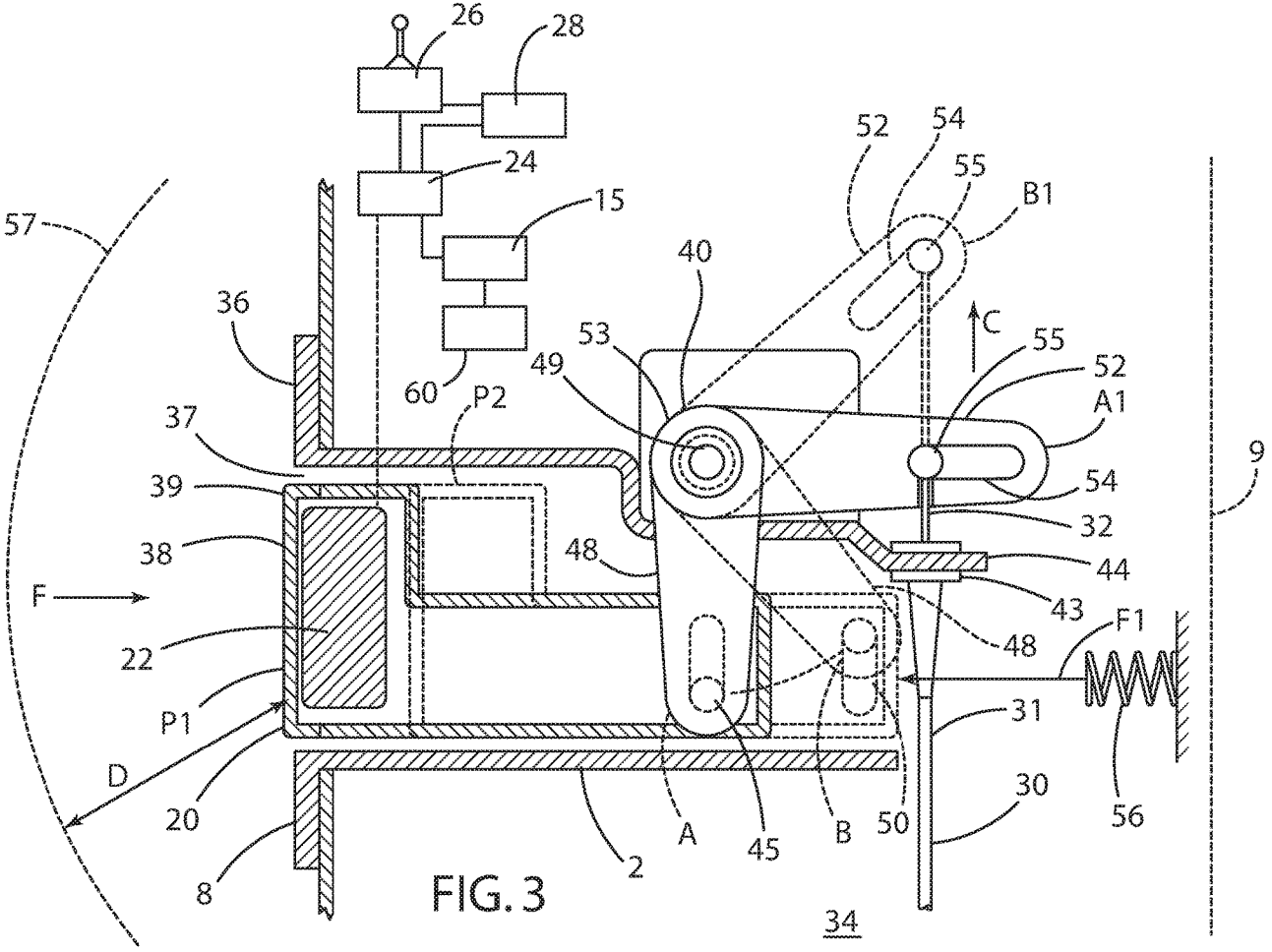
FIG. 3 is a cross-sectional view of a portion of the door taken along the line 3-3 of FIG. 2.

With further reference to FIGS. 2 and 3, release member 20 may be movably connected to a housing or bezel 36 having an opening 37 that receives movable member 20. In the illustrated example, release member 20 has a flat outer surface 38 and a circular peripheral edge 39. However, it will be understood that the release member 20 may comprise a variety of shapes, depending upon the particular vehicle or application. Release member 20 may include a design or other indicia 42 representing the vehicle make and/or providing a decorative appearance. Also, movable member 20 may comprise a button or the like that moves linearly as shown in FIG. 3, or it may comprise a lever or other such movable member.

Referring again to FIG. 3, mechanical cable 30 is mounted to inner vehicle door structure 44 utilizing a conventional fitting 43 or the like. A bellcrank 40 includes a center section 53, a first arm 48, and a second arm 52. Bellcrank 40 is rotatable mounted to a pin 49. First arm 48 includes a pin or boss 45 that is received in an elongated slot 50 of release member 20. Second arm 52 includes an elongated slot 54 that receives an end fitting 55 that is connected to an end of flexible inner cable 32. End fitting 55 may be configured to operably engage a linear guide (not shown) that constrains movement of fitting 55 such that I travels along a linear path.

If a sufficiently large force "F" is applied to release member 20 by a user, release member 20 moves from the position "P1" to an inner position "P2." As the release member 20 moves from position P1 to position P2, pin 45 moves upwardly in slot 50 of release member 20, thereby rotating first arm 48 from position "A" to position "B." As arm 48 rotates, second arm 52 rotates from position "A1" to position "B1." As arm 52 rotates, an end fitting 55 of flexible inner cable 32 moves in slot 54 of arm 52 thereby pulling shifting flexible inner cable 32 in a linear manner in the direction "C." A spring 56 (FIG. 3) provides a biasing force F1 tending to prevent movement of release member 20 from position P1 to position P2, and causing movement of release member 20 from position P2 back to position P1 when a force F is no longer applied to release member 20.

Referring again to FIG. 1, cable 30 operably interconnects release member 20 and powered latch device 10. Powered latch device 10 is configured such that movement of inner cable 32 causes movable latch member 11 to shift from a latched position to an unlatched position. As discussed in more detail in previously identified U.S. Pat. Nos. 8,746,755, 8,544,901; and 8,573,657, powered latch 10 may be configured such that a first push on release member 20 by a user shifts or changes the powered latch device from a locked position/state ("locked") to an unlocked position/state ("unlocked state"), but does not shift movable latch member 11 from a latched position to an unlatched position. Powered latch device 10 may be configured to shift movable latch member 11 from a latched position to an unlatched position if release member 20 is pushed twice. In this example, a first movement of release member 20 causes powered latch device 10 to shift from a "double locked" state to a "single locked" state, and a second movement of release member 20 causes the powered latch device 10 to change from the "single locked" state to an unlatched state. When in the unlatched state, powered latch device 10 actuates solenoid 12, and solenoid 12 shifts latch member 11 from a latched position to an unlatched position. Thus, powered latch device 10 and release member 20 can be configured to provide unlatching based on two separate movements of member 20 in a manner that is similar to the two pulls that are required to unlock and unlatch a door having a conventional mechanical door handle and lock/latch.

Movable release member 20 may include a capacitive or proximity sensor 22 (FIG. 3) that is operably connected with controller 24. Sensor 22 may be configured to generate a signal if an object such as a user's hand has come within a predefined distance "D" (dashed line 57) of sensor 22. Sensor 22 may be configured to provide a signal if an object comes closer than the predefined distance D, sending a signal to controller 24 if this occurs. Alternately, sensor 22 may be configured to provide a variable signal to controller 24 corresponding to a variable distance of an object from sensor 22, and controller 24 may be configured to determine if the object is closer than a predefined distance D based on the variable signal.

Controller 24 may be configured to release latch 10 if an object closer than the predefined distance "D" is detected twice within a predefined time. For example, the predefined distance D could be in the range of about 0 to 6 inches. It will be understood that the magnitude of the predefined distance D may be set for the requirements of a particular application. Specifically, the same release member 20 may be utilized in different vehicle types or models, and the distance D can be set as required for each type of vehicle. Also, the time interval between detection of an object within distance D may also be set for a particular application. For example, the time interval may be in the range of 0 seconds to about 5 seconds, 0 seconds to about 2 seconds, or other suitable time interval. Latch device 10 may have three different "states" or conditions corresponding to states or conditions of conventional mechanical door handles, latches, and locks. Specifically, latch device 10 may include a start or first ("locked") state, an "unlocked" or second state, and an "unlatched" or third state. Latch device 10 may be configured to reset to the first state (locked and latched) automatically such that the first state is the default state. If latch device 10 is in the default/first state and it receives a signal indicating that an object is closer than the predefined distance D, latch device 10 shifts from the first state to the second "unlocked" state. If an object is not detected within distance D within a predefined time interval, latch device 10 resets to the first state. However, if two discreet occurrences of an object being within distance D occur within the predefined time interval, latch device 10 changes from the first state to the second state, and then from the second state to the third state. Once the latch device 10 shifts to the third state, powered latch device 10 causes actuator 12 to unlatch movable latch member 11.

Controller 24 may be configured to provide a signal to powered latch device 10 under certain vehicle operating conditions. For example, controller 24 may be configured such that a signal allowing unlatching of latch device 10 is only generated if main power supply 15 is operational and gear shift selector 26 (and transmission 28) are in Park. In this way, inadvertent latch release while the vehicle is moving is prevented, even if an object is moved within the predefined distance D within the predefined time interval. Also, controller 24 may be operably connected to a vehicle speed indicator (not shown), whereby the powered latch is only unlatched if the vehicle speed is at or below a predefined level. Also, powered actuator 12 may be a solenoid that is powered only when the vehicle is parked to thereby prevent inadvertent release when the vehicle is in motion. Under power loss from main vehicle power supply 15 or low battery conditions, a backup power supply such as a battery 60 or capacitor (not shown) can be utilized to power the latch device 10, and release member 20 can be shifted mechanically to release the latch 11.

However, if power is being supplied by main power supply 15 at a normal or acceptable level, and if the vehicle is in motion (e.g. not in Park) mechanical activation of release member 20 will not release the movable latch member 11 due to the logic programmed into controller 24. As described in more detail in U.S. Pat. Nos. 8,746,755; 8,544,901; and 8,573,657, powered latch device 10 includes a mechanism that mechanically sets the latch device such that latch member 11 unlatches if release member 20 is pushed a second time. Also, powered latch device 10 may include a micro switch (not shown) or other suitable sensor that generates a signal to controller 24 upon movement of an internal latch member that is mechanically connected to inner cable member 32. In this way, controller 24 can determine if release member 20 has been shifted twice within a predefined time interval, and controller 24 can actuate the solenoid/powered actuator 12 upon a second push/movement of release member 20.

As discussed above, controller 24 may be configured to prevent shifting of movable latch member 11 to an unlatched position if the vehicle is moving. Specifically, controller 24 may be configured to continuously and automatically reset to the first state at very short time intervals unless the controller determines that the vehicle is Parked. Thus, if the vehicle is in motion and movable release member 20 is pushed twice within the predefined time interval, controller 24 prevents actuation of solenoid 12 by rapidly resetting to the first state before a user is able to push or release member 20 a second time. Thus, the movements of release member 20 when the vehicle is not in Park result in powered latch device 10 shifting from the first state to the second state, even if release member 20 is manually moved twice within the predefined time interval. This prevents shifting to the third state which would otherwise permit movement of movable latch member 11 to an unlatched position.

If powered latch device 10 is configured to continuously reset to the first state at a rapid rate unless the vehicle is in Park, detection of an object within predefined distance D by sensor 22 within a predefined time interval will also not result in shifting of movable latch member 11. More specifically, a first detection of an object within the predefined distance resets powered latch device 10 to the second state. However, powered latch device 10 rapidly resets (within a fraction of a second) to the first state unless the vehicle is in Park, such that detection of an object within the predefined distance D a second time will not cause powered latch device 10 to shift from the second state to the third state. In general, powered latch device 10 is configured to automatically reset from the second state to the first state if the vehicle is not in Park at a very rapid rate at very small time intervals that are much less than the predefined time interval between detected movements of release member 20 (or detections of an object by sensor 22) that would otherwise result in release of the powered latch 10. Also, it will be understood that powered latch device 10 and controller 24 may utilize additional vehicle operating parameters (other than the vehicle being in Park) to determine if powered latch device 10 should be unlatched.

It will be understood that the powered latch device 10 may be configured to require activation (i.e. "power on") of solenoid 12 to unlatch powered latch 10. Alternately, a spring or the like may be utilized to store energy and act in a direction that is opposite that of the solenoid to provide for actuation of the solenoid when the solenoid is changed from an energized state to a de-energized state. If configured in this way, solenoid 12 is normally actuated, and unlatching of latch device 10 requires that solenoid 12 be deenergized to allow the spring to shift latch member 11 to the unlatched position. As used herein, the term "actuation" with respect to a powered actuator such as solenoid 12 refers to both energizing and deenergizing of the powered actuator to shift latch member 11 to the unlatched position.

If the main power supply 15 is interrupted, backup power supply 60 provides sufficient power to actuate solenoid 12 to unlatch the powered latch 10. If the main power supply 15 is interrupted, a user can still unlatch the door by pushing the release member 20 twice, provided the vehicle is in Park.

Figure 4:
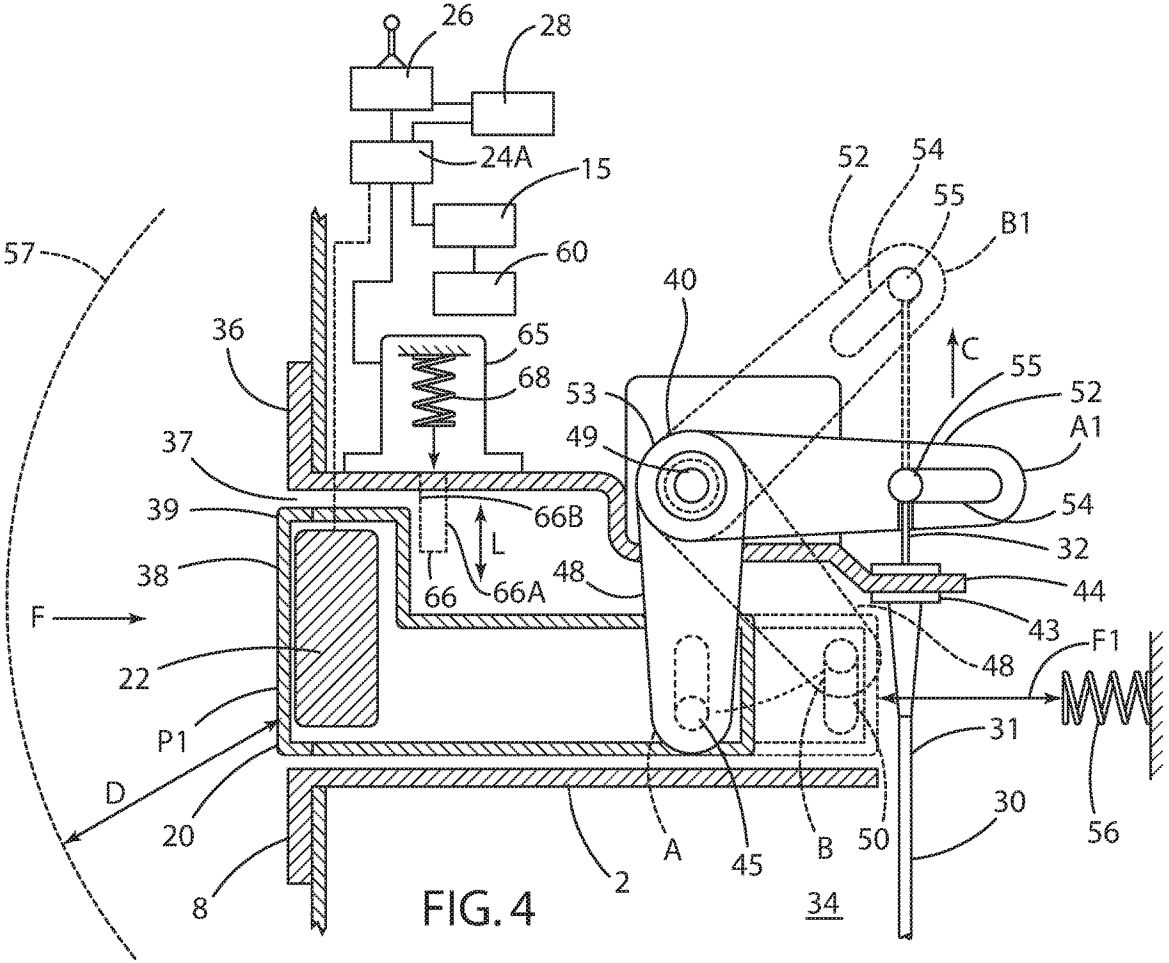
FIG. 4 is a partially fragmentary cross-sectional view of a portion of the door according to another aspect of the present invention.

With further reference to FIG. 4, a second version of the release device further includes a solenoid 65 that is utilized to prevent movement of release member 20 under specified operating conditions. Also, as discussed below, controller 24A utilizes different control logic than the device of FIG. 3. Solenoid 65 includes a movable lock member 66 that shifts in the direction of the arrow "L" between an actuated or extended position 66A and a retracted position 66B. When lock member 66 is in position 66A, lock member 66 prevents movement of release member 20 inwardly. However, when lock member 66 is retracted to the position 66B, release member 20 can be shifted inwardly in substantially the same manner as discussed above in connection with the device of FIG. 3. In the device of FIG. 4, if main power supply 15 is operating normally, controller 24A is programmed such that lock member 66 of solenoid 65 is in position 66A, thereby preventing inward movement of release member 20 if main power supply 15 is operating normally. Controller 24A may also be configured to ensure that lock member 66 is in the extended position 66A if gear shift selector 26 and transmission 28 are not in Park and/or if the vehicle speed is not below a predefined maximum speed (the predefined maximum speed may be zero). However, if main power supply 15 is interrupted spring 68 in solenoid 65 causes solenoid 65 to retract lock member 66 to retracted position 66B, thereby allowing an operator to shift release member 20 inwardly twice to release powered latch device 10. A spring 68 biases lock member 66 into the retracted position 66A, such that power must be supplied to solenoid 65 to extend lock member 66 to the extended position 66B.

Thus, in the arrangement of FIG. 4, under normal vehicle power conditions the mechanical lock-out 66 blocks the movement of release member 20, such that an operator cannot shift release member 20 while vehicle power is normal to prevent mechanical release of powered latch device 10. However, controller 24A is configured such that detection of an object within predetermined distance D within a predefined time interval causes powered latch device 10 to unlatch if power supply 15 is operating normally and the vehicle is in the Parked condition. Thus, mechanical release 20 can be utilized only if power supply 15 is interrupted, whereas the sensor 22 will cause release of powered latch device 10 if the vehicle power supply 15 is normal and the vehicle is in the Parked position. However, if the power supply 15 is operating normally and the vehicle is not in Park, sensor 22 cannot cause unlatching of powered latch device 10 due to the predefined conditions programmed into controller 24A.

Figure 5:
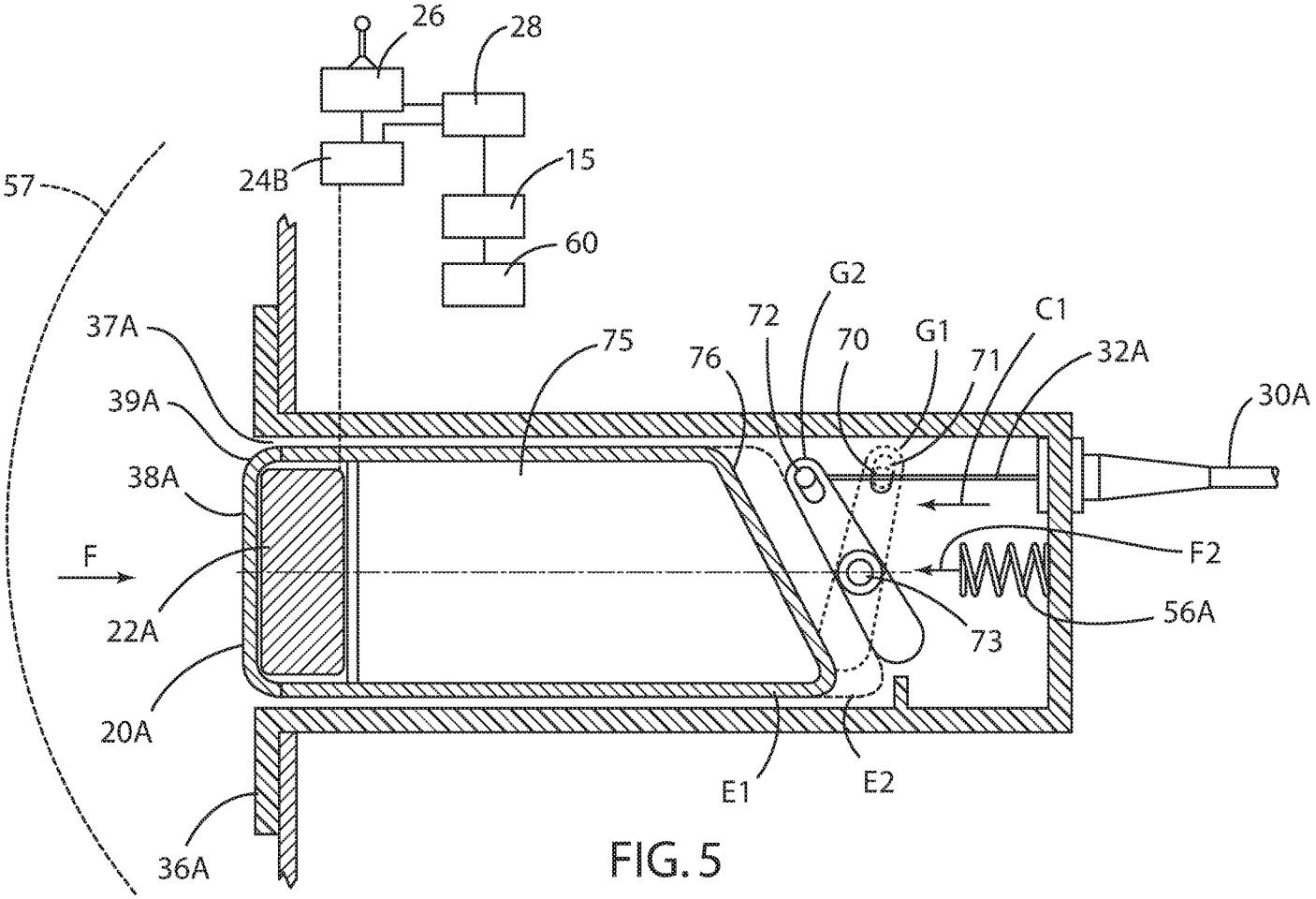
FIG. 5 is a partially fragmentary cross-sectional view of a portion of the door according to another aspect of the present invention.

With further reference to FIG. 5, a latch device according to another aspect of the present invention includes a movable member 20A that is movably disposed within a housing 36A. Release member 20A includes an extension 75 having an angled surface 76 that engages a lever 71 to rotate the lever 71 from a first position "G1" to a second position "G2." Arm 70 is rotatably mounted to a pivot member 73, and rotation of arm 70 from position G1 to position G2 generates a force shifting inner cable 32A in the direction of the arrow "C1." Thus, the device of FIG. 5 causes movement of inner cable member 32 in a manner that is similar to the device of FIG. 3. A spring 56A generates a force "F2" tending to bias release member 20A outwardly against a force F applied by an operator. Controller 24B may be configured in substantially the same manner as the devices of FIGS. 3 and 4. Also, it will be understood that a locking solenoid 65 (FIG. 4) may be utilized to prevent movement of release member 20A of the device of FIG. 5, and controller 24 may be configured in substantially the same manner as described above in connection with the device of FIG. 4.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle having a vehicle structure and a door assembly pivotably mounted to the vehicle structure for rotation about a front edge of the door assembly, the door assembly comprising:

a powered latch release device;

a vehicle door having inner and outer opposite sides;

a latch mounted to the vehicle door, the latch having a movable latch member and an electrically powered actuator that is configured to shift the movable latch member between a retaining position and a released position;

a movable release member movably disposed on the inner side of the vehicle door such that a user can push on the release member to cause movement of the release member into the door;

a mechanical member operably interconnecting the release member to the movable latch member such that movement of the release member into the door causes the movable latch member to move from the retaining position to the released position without actuation of the electrically powered actuator; and a proximity sensor mounted to the release member, wherein the proximity sensor is configured to detect an object moved to within a predefined vicinity of the sensor, and wherein the proximity sensor moves with the release member when the release member is actuated, and a controller operably connected to the electrically powered actuator and the proximity sensor, and wherein the controller actuates the electrically powered actuator and shifts the latch member from the retaining position to the released position if the proximity sensor determines that an object is within the predefined vicinity, even if the release member is not moved.

2. The vehicle door assembly of claim 1, including:

a support member movably supporting the release member for linear reciprocating motion in an inward direction and an opposite outward direction.

3. The vehicle door assembly of claim 2, wherein: the mechanical member comprises an elongated cable that shifts between a rest position and an actuated position upon movement of the release member; and the latch defines a locked mode in which the movable latch member is in its latched position, and wherein a single longitudinal shifting of the elongated cable from its rest position to its actuated position causes the latch to change from the locked mode to an unlocked mode with the movable latch member remaining in its latched position, and wherein shifting of the elongated cable from its rest position to its actuated position a second time causes the movable latch member to shift from its latched position to its unlatched position.

4. The vehicle door assembly of claim 1, wherein:

the predefined vicinity includes contact with the proximity sensor.

5. The vehicle door assembly of claim 1, wherein:

the predefined vicinity does not include contact with the proximity sensor.

6. The vehicle door assembly of claim 1, wherein:

the controller is configured such that the powered actuator only releases the latch member if the proximity sensor senses the presence of an object twice within a predefined time interval.

7. The vehicle door assembly of claim 1, wherein:

the controller is configured to prevent shifting of the movable latch member from the retaining position to the released position if the vehicle is moving.

8. The vehicle door assembly of claim 1, wherein:

the controller prevents shifting of the movable latch member from the retaining position to the release position upon movement of the release member into the door if the vehicle is not in park.

9. The vehicle door assembly of claim 1, wherein:

the controller prevents shifting of the movable latch member from the retaining position to the release position if the vehicle is moving.

10. A vehicle door assembly including a powered latch release device, the door assembly comprising:

a vehicle door having a window and a beltline below the window, the vehicle door further including inner and outer opposite sides, the inner side having a substantially planar portion below the beltline;

a latch mounted to the vehicle door, the latch having a movable latch member and an electrically powered actuator that is configured to shift the movable latch member between a retaining position and a released position;

a movable release member movably disposed on the inner side of the vehicle door within the substantially planar portion such that a user can push on the release member to cause movement of the release member into the door;

a mechanical member operably interconnecting the release member to the movable latch member such that movement of the release member into the door causes the movable latch member to move from the retaining position to the released position without actuation of the electrically powered actuator; and a proximity sensor mounted to the release member, wherein the proximity sensor is configured to detect an object moved to within a predefined vicinity of the sensor, and wherein the proximity sensor moves with the release member when the release member is actuated, and a controller operably connected to the electrically powered actuator and the proximity sensor, and wherein the controller actuates the electrically powered actuator and shifts the latch member from the retaining position to the released position if the proximity sensor determines that an object is within the predefined vicinity, even if the release member is not moved.

11. The vehicle door assembly of claim 10, wherein;

the vehicle door is configured to be pivotably mounted to a vehicle structure for rotation about a front edge of the vehicle door.

12. The vehicle door assembly of claim 10, including:

a support member movably supporting the release member for linear reciprocating motion in an inward direction and an opposite outward direction.

13. The vehicle door assembly of claim 10, wherein: the mechanical member comprises an elongated cable that shifts between a rest position and an actuated position upon movement of the release member; and the latch defines a locked mode in which the movable latch member is in its latched position, and wherein a single longitudinal shifting of the elongated cable from its rest position to its actuated position causes the latch to change from the locked mode to an unlocked mode with the movable latch member remaining in its latched position, and wherein shifting of the elongated cable from its rest position to its actuated position a second time causes the movable latch member to shift from its latched position to its unlatched position.

14. The vehicle door assembly of claim 10, wherein:

the predefined vicinity includes contact with the proximity sensor.

* * * * *